US011217383B2

(12) United States Patent
Kawashima

(10) Patent No.: US 11,217,383 B2
(45) Date of Patent: Jan. 4, 2022

(54) COIL COMPONENT AND COIL DEVICE

(71) Applicant: SUMIDA CORPORATION, Tokyo (JP)

(72) Inventor: Hiroshi Kawashima, Natori (JP)

(73) Assignee: SUMIDA CORPORATION, Tokyo (JP)

( * ) Notice: Subject to any disclaimer, the term of this patent is extended or adjusted under 35 U.S.C. 154(b) by 514 days.

(21) Appl. No.: 16/268,612

(22) Filed: Feb. 6, 2019

(65) Prior Publication Data

US 2019/0287713 A1 Sep. 19, 2019

(30) Foreign Application Priority Data

Mar. 14, 2018 (JP) ..... JP2018-046751

(51) Int. Cl.

| | |
|---|---|
| ***H01F 17/04*** | (2006.01) |
| ***H01F 27/30*** | (2006.01) |
| ***H01F 27/28*** | (2006.01) |
| ***H01F 41/061*** | (2016.01) |

(52) U.S. Cl.

CPC ..... *H01F 27/30* (2013.01); *H01F 27/2823* (2013.01); *H01F 27/2852* (2013.01); *H01F 27/306* (2013.01); *H01F 41/061* (2016.01)

(58) Field of Classification Search

CPC ..... H01F 27/2852; H01F 41/061; H01F 27/30
USPC ..... 336/219, 220, 221
See application file for complete search history.

(56) References Cited

U.S. PATENT DOCUMENTS

2009/0144967 A1* 6/2009 Hasu ..... H01F 27/2847 29/605
2010/0026434 A1* 2/2010 Okamoto ..... H01F 27/266 336/65
2013/0088317 A1* 4/2013 Tawara ..... H01F 27/306 336/212
2013/0099887 A1* 4/2013 Yamamoto ..... H01F 30/06 336/220
2014/0152414 A1* 6/2014 Kawashima ..... H01F 27/2847 336/192
2014/0191839 A1* 7/2014 Sato ..... H01F 3/08 336/221
2016/0314897 A1* 10/2016 Misaki ..... H01F 27/2823

FOREIGN PATENT DOCUMENTS

JP 3398855 B2 4/2003

* cited by examiner

*Primary Examiner* — Ronald Hinson
(74) *Attorney, Agent, or Firm* — Oliff PLC

(57) ABSTRACT

Provided is a coil component 100 including a first coil element 111 and a second coil element 112 each formed in an angular-tubular shape and disposed in parallel, and an interconnection part 113 for connecting the both coil elements 111, 112. The interconnection part 113 is configured with a first connecting part 123A, a second connecting part 123B, an intermediate part 123C, and an inverted part 123D. The first connecting part 123A is configured with a flatwise-bending portion 123A1 and an edgewise-winding portion 123A2. The second connecting part 123B is configured with a flatwise-bending portion 123B1 and an edgewise-winding portion 123B2. The intermediate part 123C is provided to extend over a gap part 115 between the second coil element 112 and the first coil element 111 on a front end-face side without being twisted.

5 Claims, 10 Drawing Sheets

COIL COMPONENT AND COIL DEVICE

RELATED APPLICATION

This application claims the priority of Japanese Patent Application No. 2018-046751 filed on Mar. 14, 2018, which is incorporated herein by reference.

BACKGROUND OF THE INVENTION

Field of the Invention

The present invention relates to a coil component and a coil device used for inverter circuits and various motors and the like used for automobiles and the like and, more specifically, to a coil component configured with two angular-tubular shaped laminated coils formed with a single flat wire and provided adjacent to each other and to a coil device using the same.

Description of the Prior Art

A coil component such as a reactor can generate an inductance with a structure where a winding coil is wound around a magnetic core.

There are various types known as the reactors depending on the purpose of use from a type of a large capacitance used for a power transmission system to a component of a communication apparatus.

Incidentally, as the reactors or the like used for booster circuits used on board, known is a type formed by placing two laminated coil components in parallel so that a high inductance value can be acquired when a high electric current is flown.

As a conventional example of such reactors, known is a type acquired by forming two coil elements disposed in parallel through edgewise-winding a single flat wire (see Japanese Patent No. 3398855, for example).

In Japanese Patent No. 3398855, a first coil element and a second coil element are formed in parallel acquired by winding the flat wire with edgewise-winding while shaping the wire into a circular shape. The flat wire drawn between the two coil elements is drawn from one element to the other by being twisted by 180 degrees between the two coil elements.

SUMMARY OF THE INVENTION

In the technique depicted in Japanese Patent No. 3398855 described above, however, the twisted flat wire comes in a gap between the two coil elements so that a distance between the two coil elements is expanded. Therefore, it is difficult to downsize the coil device.

Expansion of the gap between the two coil elements even by several millimeters, for example, results in a great deterioration in the magnetic property, so that it is desired to employ a structure causing no such twisting of the flat wire used for connecting the coil elements.

In view of such circumstances, it is an object of the present invention to provide a coil component and a coil device capable of causing the gap between the coil elements to be a small distance and downsizing the device and preventing drastic deterioration in the magnetic property.

In order to solve the above problem, the coil component and the coil device according to the present invention include following features.

The coil component according to the present invention includes: a first coil element and a second coil element formed by dividing and folding, at a prescribed interconnection position, into two a winding coil formed by laminating a single flat wire into a rectangular shape with edgewise-winding, the first coil element and the second coil element being disposed with opposing side-faces placed along in parallel to each other; and an interconnection part to connect those two coil elements.

Provided that, a side of the first coil element and a side of the second coil element adjacent to each other among each of sides of a rectangular part forming interconnection end-faces of each of the coil elements and sides in parallel to those sides are referred to as first sides, the interconnection part connects the first side of the first coil element with the first side of the second coil element, and the interconnection part includes a first connecting part configured by, in an interconnection edge portion connected to one of the coil elements, bending and raising the first side at a right angle and then bending at a right angle in a manner of edgewise-winding toward a direction leaving away from another one of the coil elements along the interconnection end face, a second connecting part configured by, in another interconnection edge portion connected to the other one of the coil elements, bending and raising the first side at a right angle and then bending at a right angle in a manner of edgewise-winding toward a direction approaching the one of the coil elements along the interconnection end-face, an intermediate part including a linear face in parallel to a plane that is in parallel to both a disposing direction of the two coil elements and an axial direction of the two coil elements, the intermediate part being extended from the second connecting part toward a direction of the first connecting part to be drawn over a gap between the first coil element and the second coil element, and an inverted part in a 180-degree-folded shape for connecting an edge of the intermediate part and an edge of the first connecting part.

Further, when the first sides located on neighboring inner sides of the first coil element and the second coil element are referred to as inner first sides and the first sides located on outer sides are referred to as outer first sides, either one of the first connecting part and the second connecting part is connected in vicinity of an edge of one of the inner first sides of one of the two coil elements or on an extension of the inner first side, and the other one of the first connecting part and the second connecting part is connected in vicinity of an edge of the one of the outer first sides of the other one of the two coil elements or on an extension of the outer first side.

Preferably, a linear face of the flat wire configuring the first connecting part and a linear face of the flat wire configuring the intermediate part are in parallel to each other.

Preferably, a coil device according to the present invention includes the coil component mentioned above and a magnetic core forming a closed magnetic path by inserting each leg part into a hollow part of the coil component.

Further, the coil device according to the present invention includes a pair of device leg parts for holding a coil device main body formed by combining the coil component and the magnetic core at a prescribed position; and a long screw provided between corner areas of the two coil elements for pinching the coil component between the pair of device leg parts.

Note here that "edgewise-winding" mentioned above refers to a winding method with which the flat wire is wound vertically and laminated in a tabular form having a short side that is one of side edges of the flat wire as an inner diameter face.

In the coil component according to the present invention, the interconnection part for connecting the first coil element and the second coil element is configured with the first connecting part, the second connecting part, the intermediate part, and the inverted part. Each of those parts is disposed on a front end-face side of the both coil elements via which the first coil element and the second coil element are connected. Further, the intermediate part provided to be drawn from one of the first coil element and the second coil element to the other is disposed to have the linear face in parallel to the plane that is in parallel to both the disposing direction of the two coil elements and the axial direction of the two coil elements. Therefore, unlike the conventional technique described above, there is no risk of causing the part drawn between the first coil element and the second coil element to be twisted and caught between the both coil elements. This excludes having difficulty in downsizing the coil device caused by expansion of the distance between the two coil elements.

The interconnection part is configured to connect the first side of the first coil element and the first side of the second coil element. Therefore, the intermediate part of the interconnection part is designed to be parallel to the plane that is in parallel to both the disposing direction of the two coil elements and the axial direction of the two coil elements, and the linear face without twisting can be formed easily.

In the coil component and the coil device according to the embodiment of the present invention as described above, the intermediate part provided to be drawn from one of the first coil element and the second coil element to the other is disposed to have the linear face in parallel to the plane that is in parallel to both the disposing direction of the two coil elements and the axial direction of the two coil elements. Therefore, even when the both leg parts are simply fastened into the coil device main body by placing the long screw in the valley space between corner areas of the both coil elements facing each other, the long screw can be provided in parallel to the linear face of the intermediate part. As a result, mutual interference can be avoided easily.

DESCRIPTION OF THE PREFERRED EMBODIMENTS

Hereinafter, coil components according to preferred embodiments of the present invention will be described by referring to the accompanying drawings. The coil components of the preferred embodiments are applied to reactors, for example.

A reactor is used as an electric circuit element of various apparatuses loaded on automobiles, for example, and includes a magnetic core and a reactor coil wound around the core. Normally, a leg part is attached to a reactor main body formed by inserting the reactor core inside the reactor coil so that the reactor main body can be housed in a casing while securing an insulation property between the reactor main body and the casing.

Embodiment 1

Figure 1:
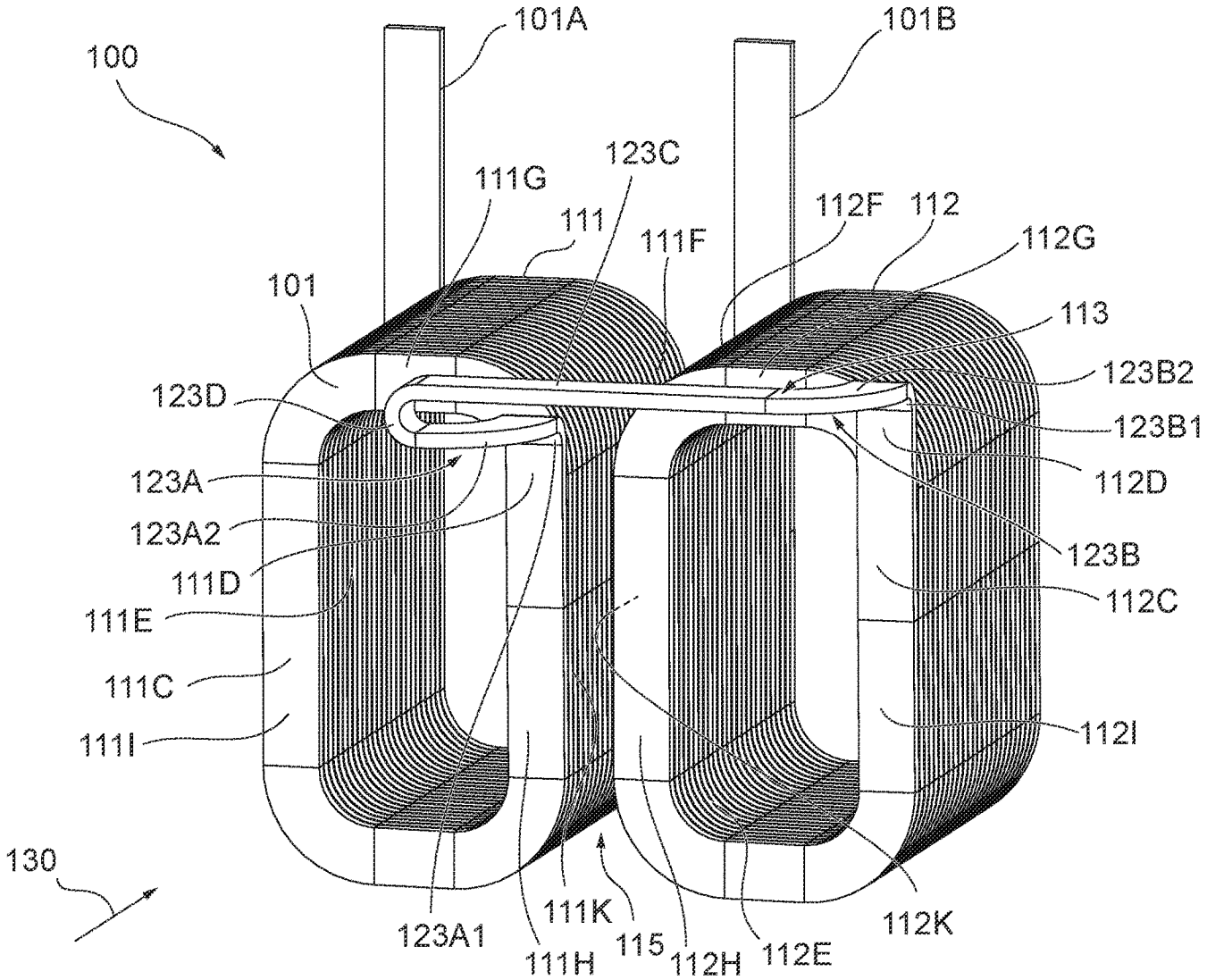
FIG. 1 is a perspective view of a coil component according to a first embodiment of the present invention.
Figure 2:
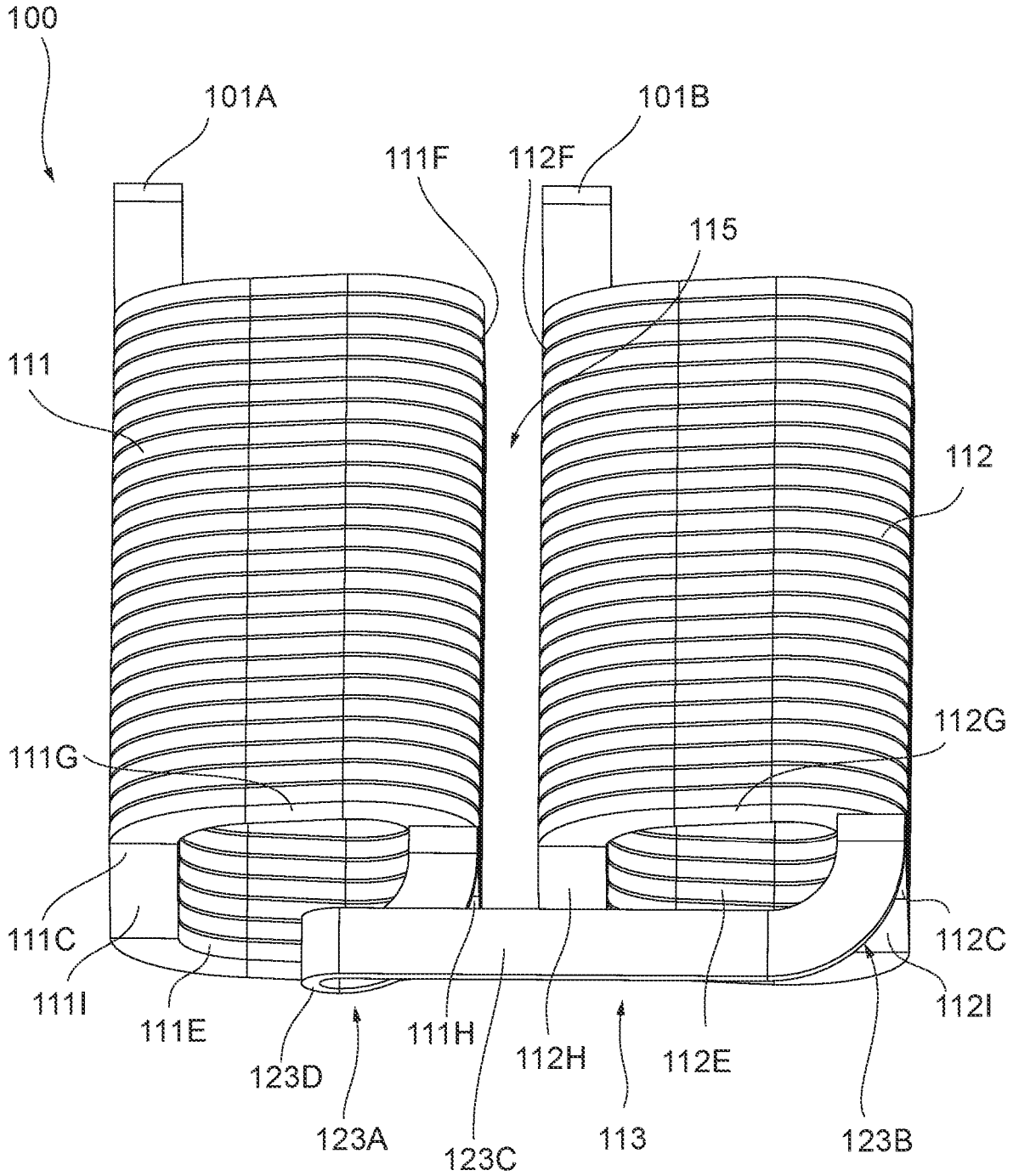
FIG. 2 is a perspective view showing a state of the coil component according to the first embodiment shown in FIG. 1 viewed from above.
Figure 3:
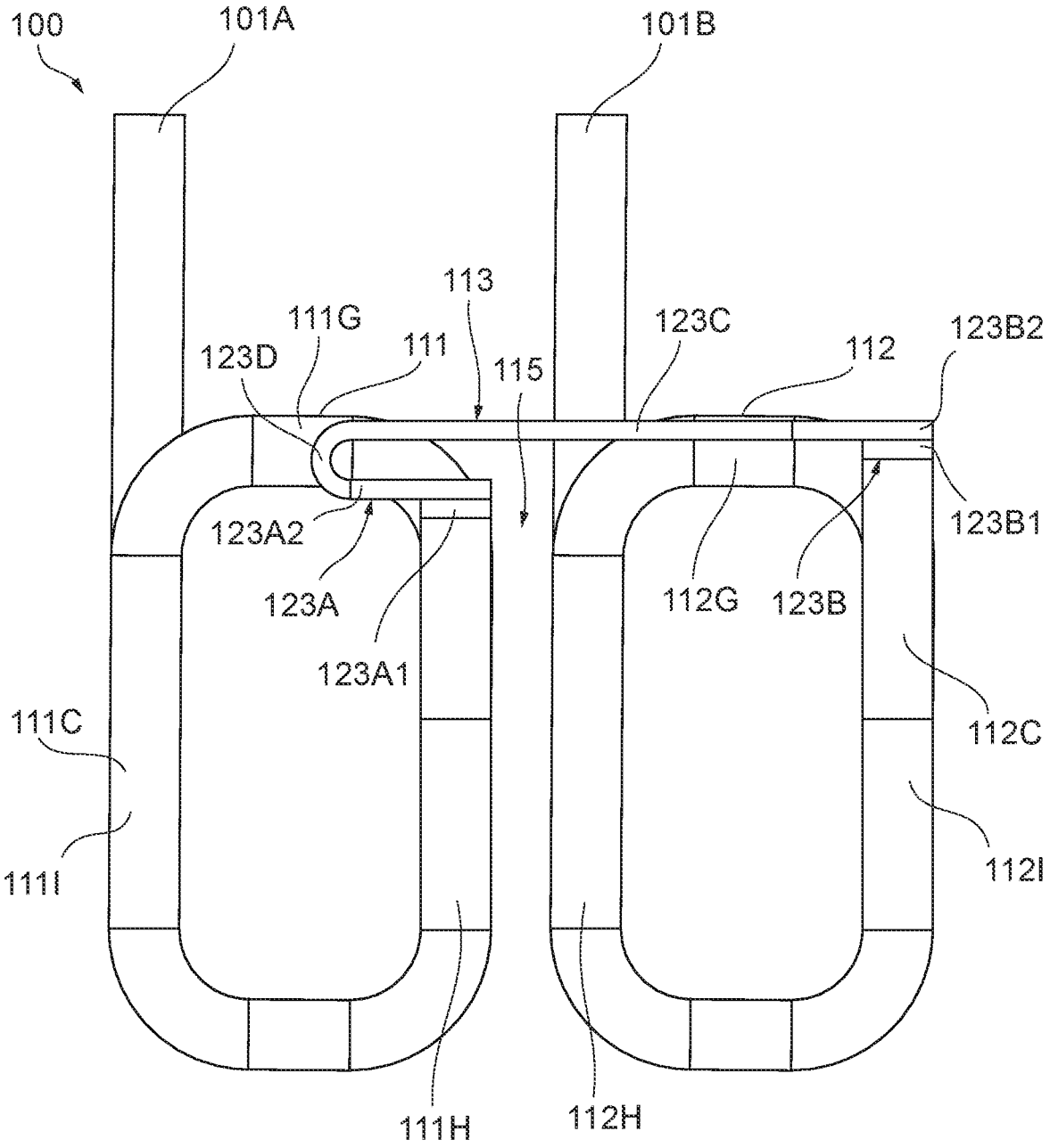
FIG. 3 is a front view of the coil component according to the first embodiment shown in FIG. 1.

FIG. 1 is a perspective view showing a state of a coil component according to a first embodiment of the present invention viewed from a front side. FIG. 2 is a perspective view showing a state of the coil component according to the first embodiment shown in FIG. 1 viewed from above. FIG. 3 is a front view showing a state of the coil component according to the first embodiment shown in FIG. 1 viewed from the front side.

As shown in FIG. 1, a coil component 100 of the first embodiment is formed by winding and laminating a single flat wire 101 in one direction with edgewise-winding between one end portion 101A and another end portion 101B as connection terminals, and bending the wound and laminated coil into two at a prescribed position (normally at substantially middle position) to provide a first coil element 111 and a second coil element 112 each formed in an angular-tubular shape and disposed in parallel and to provide an interconnection part 113 for connecting the both coil elements 111 and 112.

The flat wire 101 has a rectangular cross section and is formed by applying insulation coating on the surface of a copper wire, for example.

The first coil element 111 and the second coil element 112 are disposed in parallel such that opposing single side-face 111K and single side-face 112K are placed along in parallel to each other with a prescribed space (gap part 115) provided therebetween.

The interconnection part 113 is configured with a first connecting part 123A, a second connecting part 123B, an intermediate part 123C, and an inverted part 123D.

The first connecting part 123A is configured with: a flatwise-bending portion 123A1 where the flat wire 101 of the coil element 111 in a coil element winding end portion 111D (first side) is bent toward the front side at a right angle in a manner of flatwise-bending; and an edgewise-winding portion 123A2 where, continuously from the flatwise-bending portion 123A1, the flat wire 101 is bent at a right angle in the manner of edgewise-winding toward a direction leaving away from the coil element 112 and to be along a lateral side (second side) 111G of the first coil element 111.

The second connecting part 123B is configured with: a flatwise-bending portion 123B1 where the flat wire 101 of the coil element 112 in a coil element winding start portion 112D (first side) is bent toward the front side at a right angle in a manner of flatwise-bending; and an edgewise-winding portion 123B2 where, continuously from the flatwise-bending portion 123B1, the flat wire 101 is bent at a right angle in the manner of edgewise-winding toward a direction approaching the coil element 111 and to be along a lateral side 112G of the second coil element 112.

Considering the second connecting part 123B as the starting point, the intermediate part 123C is extended to the direction of the first connecting part 123A drawn from the second coil element 112 side toward the first coil element 111 side and configured to have a linear face in parallel to a plane that is in parallel to both a disposing direction of the two coil elements 111, 112 and an axial direction of the two coil elements 111, 112.

The inverted part 123D is formed in a 180-degree-folded shape by being bent in a vertical direction to connect an edge of the intermediate part 123C on the first connecting part 123A side and an edge of the edgewise-winding portion 123A2 of the first connecting part 123A.

In the coil component according to the present embodiment, as described above, the interconnection part 113 connecting the first coil element 111 and the second coil element 112 is configured with the first connecting part 123A, the second connecting part 123B, the intermediate part 123C, and the inverted part 123D. Each of those parts is disposed on an interconnection end-face 130 side as the front side of the both coil elements 111, 112, via which the first coil element 111 and the second coil element 112 are connected. Further, the intermediate part 123C provided to be drawn from one of the first coil element 111 and the second coil element 112 to the other is disposed to have the linear face in parallel to the plane that is in parallel to both the disposing direction of the two coil elements and the axial direction of the two coil elements. Further, the interconnection part 113 is configured to connect an inner first side 111C of the first coil element 111 (the first side 111C corresponds to inner and outer longitudinal sides of the first coil element 111 in FIG. 1) with an outer first side 112C of the second coil element 112 (the first side 112C corresponds to inner and outer longitudinal side of the second coil element 112 in FIG. 1). Therefore, unlike the conventional technique mentioned above, it is possible to easily prevent the part drawn between the first coil element 111 and the second coil element 112 from being twisted and caught between the both coil elements 111 and 112.

This makes it possible to inhibit expansion in the size of the core and to avoid deterioration of the magnetic property.

In the present embodiment, the interconnection part 113 connects the coil element winding end portion 111D located at an inner longitudinal side 111H of the first coil element 111 with the coil element winding start portion 112D located at an outer longitudinal side 112I of the second coil element 112. However, it is also possible to connect prescribed portions of other longitudinal sides (the coil element winding end portion located at an outer longitudinal side 111I of the first coil element 111 with the coil element winding start portion located at the outer longitudinal side 112I of the second coil element 112, the coil element winding end portion located at the outer longitudinal side 111I of the first coil element 111 with the coil element winding start portion located at an inner longitudinal side 112H of the second coil element 112, or the coil element winding end portion located at the inner longitudinal side 111H of the first coil element 111 with the coil element winding start portion located at the inner longitudinal side 112H of the second coil element 112).

Regarding the coil component 100 shown in FIG. 1, left and right leg parts of a pair of U-shape cores 151, 152 are inserted into hollow parts 111E, 112E of the two coil elements 111, 112 and abutted against each other inside the hollow parts 111E, 112E so as to configure the reactor main body.

Figure 4:
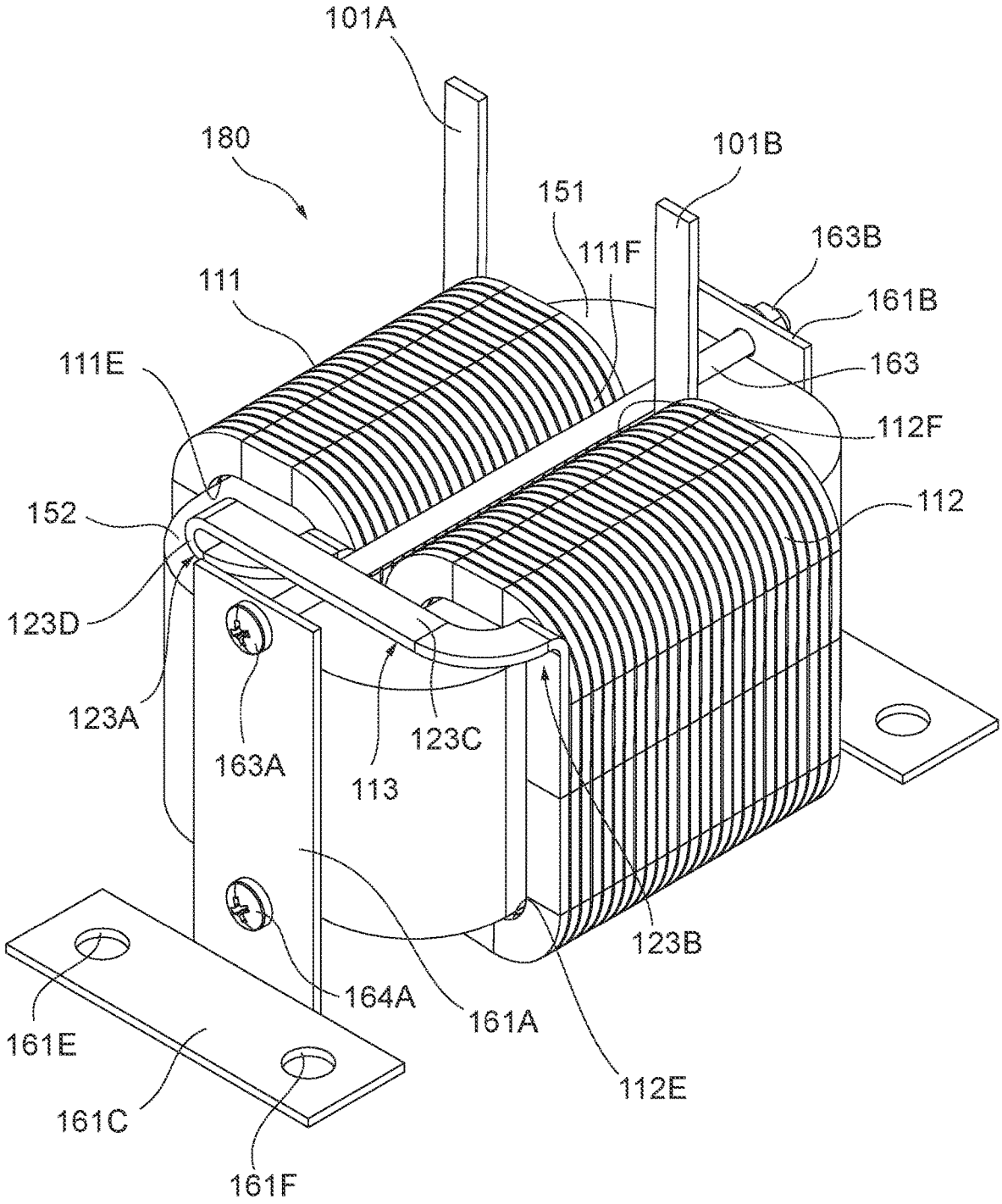
FIG. 4 is a perspective view showing a state where leg parts are attached to a coil device main body including the coil component according to the first embodiment shown in FIG. 1 loaded thereon.
Figure 5:
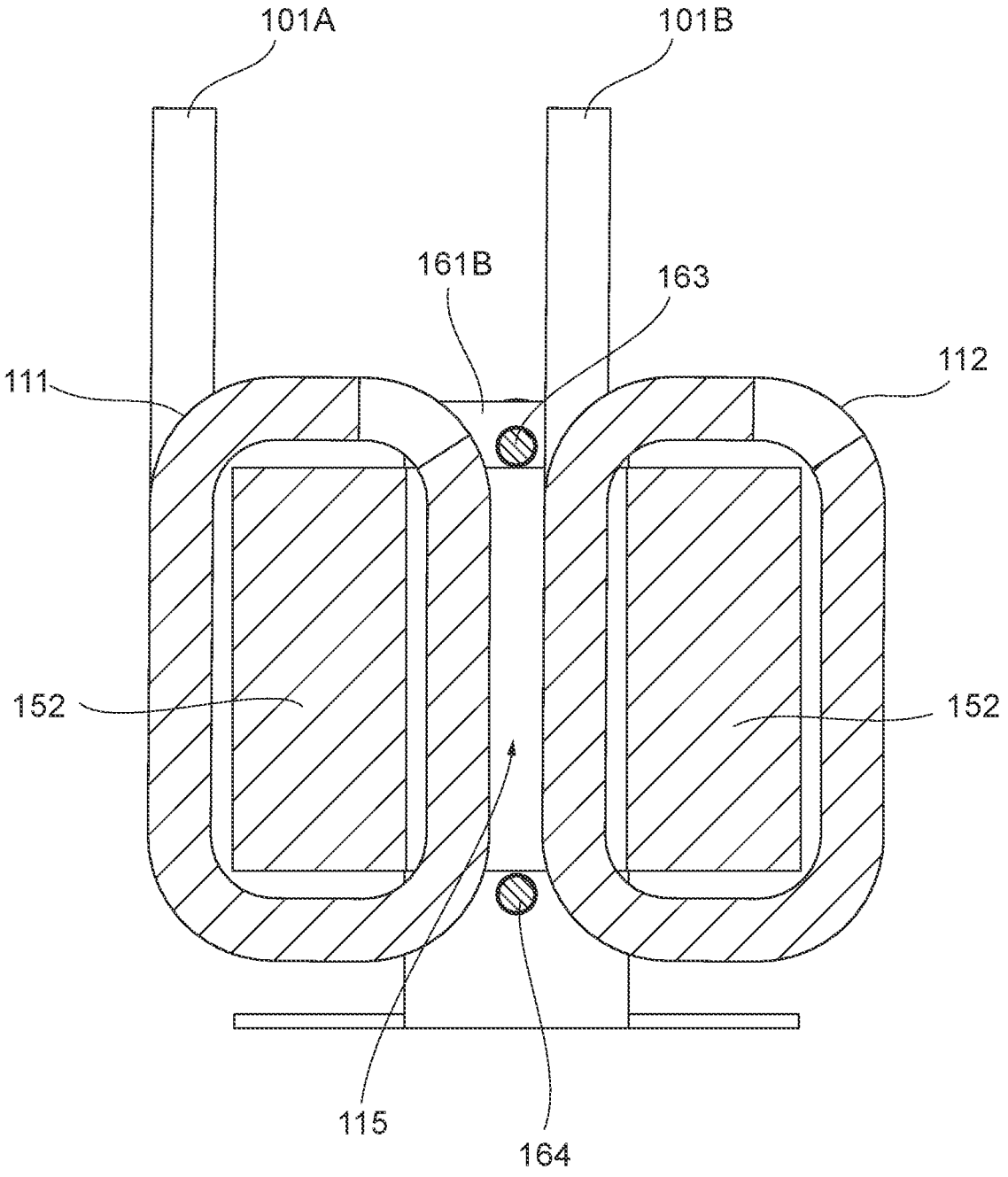
FIG. 5 is a sectional view of the structure shown in FIG. 4 taken from a front-side.

Further, FIG. 4 shows a coil device in which a pair of leg parts 161A, 161B are attached to a reactor main body 180 acquired by combining the coil component 100 shown in FIG. 1 with the pair of cores 151, 152, and the coil component 100 is disposed at a position brought upward with respect to attachment plates 161C, 161D (not shown) of the leg parts 161A, 161B for a casing or the like. FIG. 5 is a perspective view showing a sectional view of the structure shown in FIG. 4.

Note that the leg parts 161A, 161B are fixed by turning screws, not shown, into the casing or the like via screw holes 161E, 161F.

A screw head 163A of a long screw 163 is turned to be screwed into a nut 163B such that the pair of leg parts 161A, 161B are pressurized to a direction to which the two cores 151, 152 are pressed against each other. Similarly, in a fastening structure provided in a lower part of the cores 151, 152, a screw head 164A of a long screw 164 (see FIG. 5) is turned to be screwed into a nut 164B (not shown) such that the pair of leg parts 161A, 161B are pressurized to a direction to which the two cores 151, 152 are pressed against each other.

Through providing the leg parts 161A, 161B of such structure, the both leg parts 161A, 161B are fixed to the peripheral surface of the cores 151, 152. Therefore, the position of the reactor main body 180 in the vertical direction can be set at a position brought up by a prescribed distance from the attaching position of the casing or the like of the attachment plates 161C, 161D (not shown) for attaching the both leg parts 161A, 161B so as to keep the insulation property.

Further, the intermediate part provided to be drawn from one of the first coil element 111 and the second coil element 112 to the other is provided to have the linear face in parallel to the plane that is in parallel to both the disposing direction of the two coil elements 111, 112 and the axial direction of the two coil elements 111, 112. Thereby, the long screws 163, 164 for easily attaching the both leg parts 161A, 161B to the coil device main body 180 placed through a valley space between corner areas 111F, 112F of the both coil elements 111, 112 facing each other can be easily provided to be in parallel to the linear face of the intermediate part. Therefore, mutual interference can be avoided easily, and efficiency of such attachment via the long screws described above can be secured.

Figure 6:
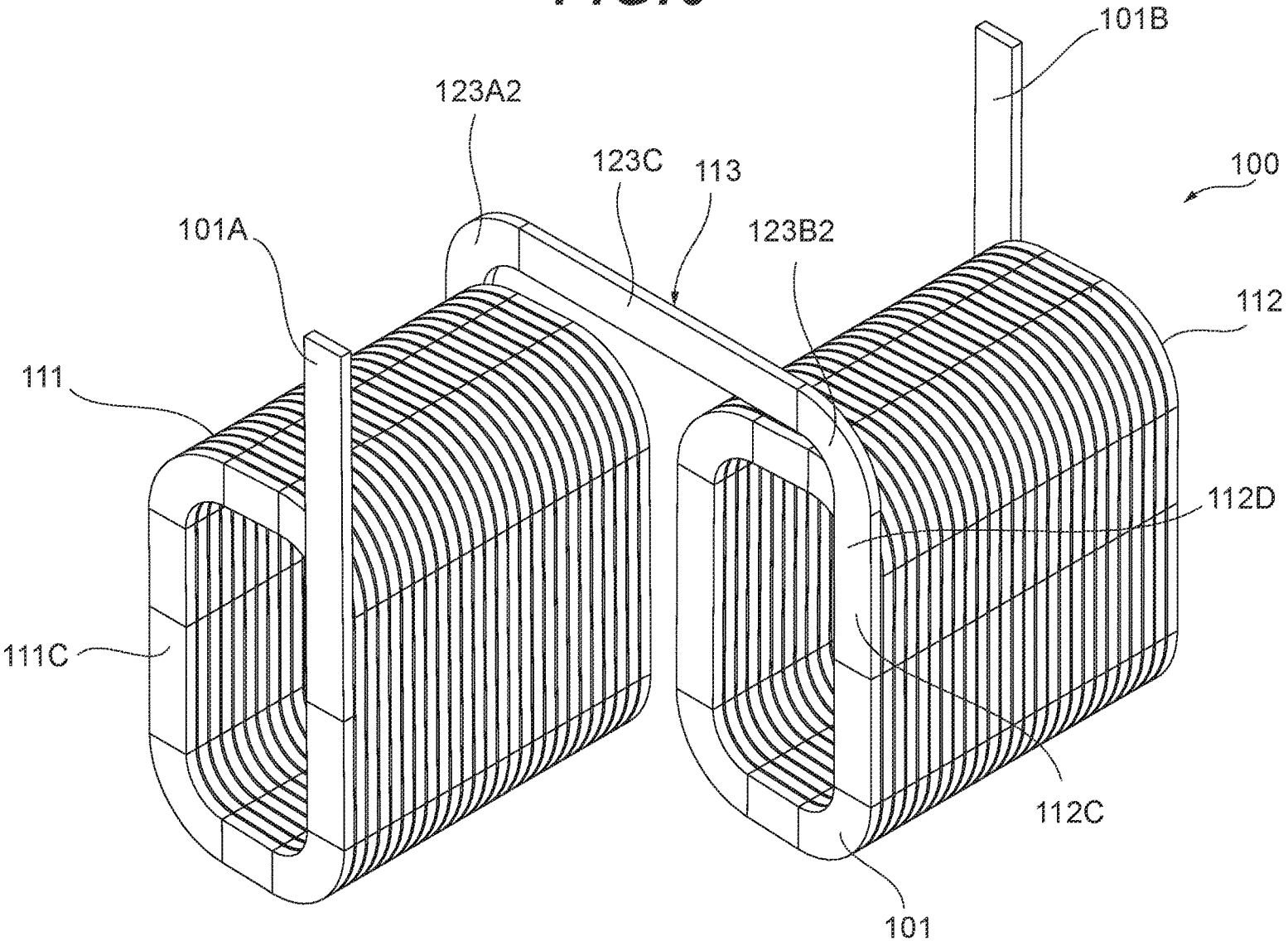
FIG. 6 is a perspective view showing a manufacturing method (manufacturing step 1) of the coil component according to the first embodiment shown in FIG. 1.
Figure 7:
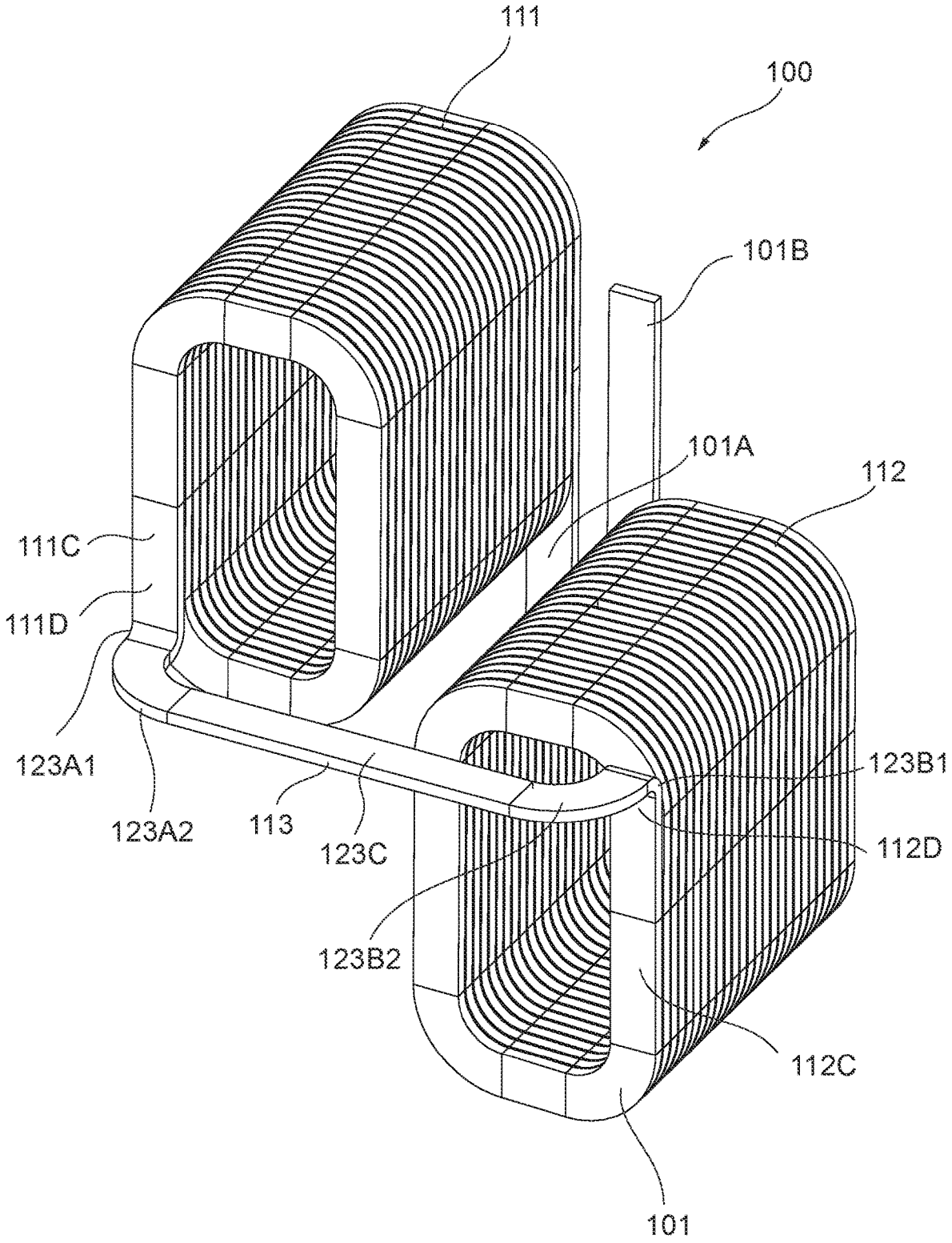
FIG. 7 is a perspective view showing the manufacturing method (manufacturing step 2) of the coil component according to the first embodiment shown in FIG. 1.
Figure 8:
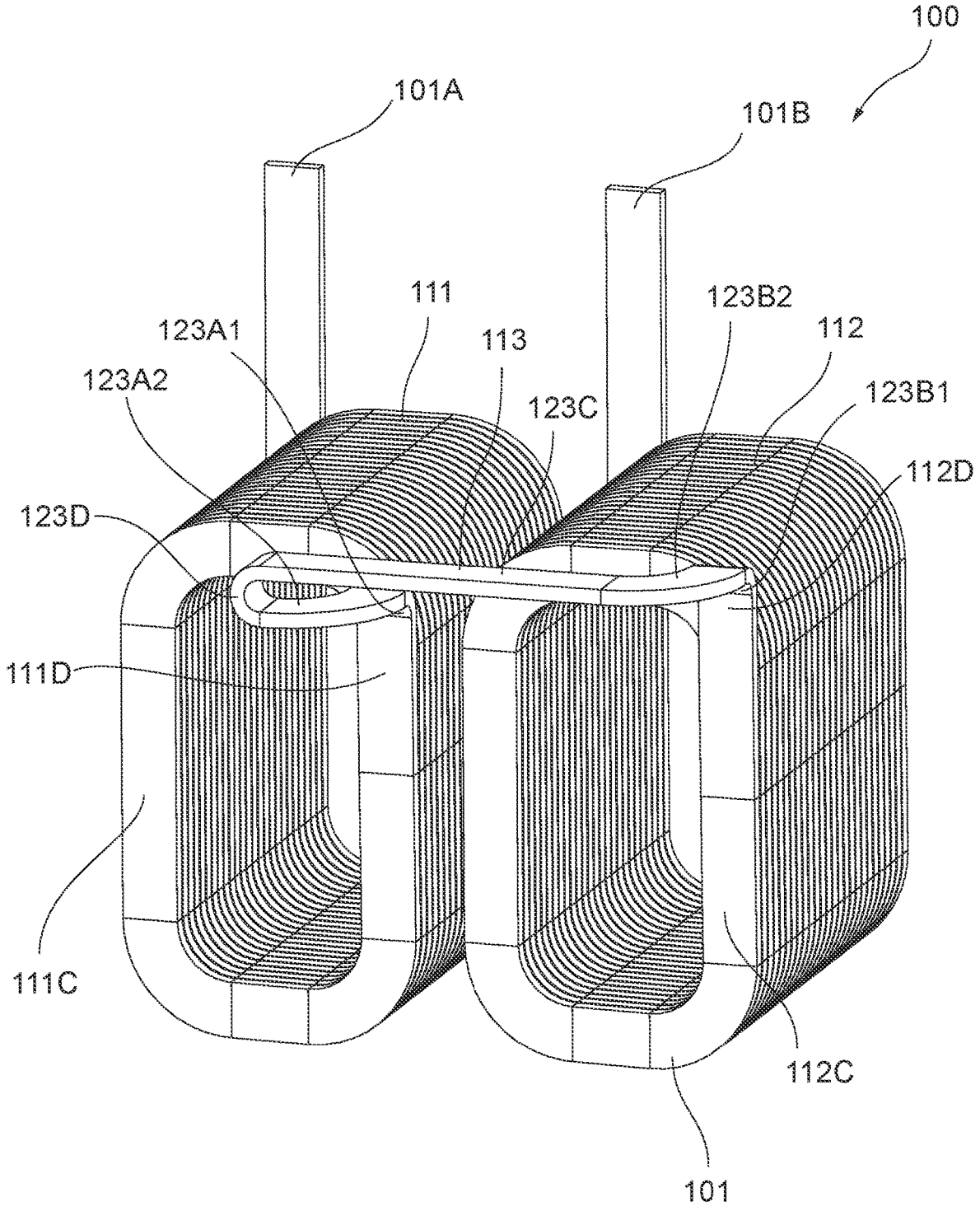
FIG. 8 is a perspective view showing the manufacturing method (manufacturing step 3) of the coil component according to the first embodiment shown in FIG. 1.

FIG. 6 to FIG. 8 are views showing steps of a manufacturing method of the coil component according to the first embodiment.

First, as shown in FIG. 6, one flat wire 101 is wound to form the two coil elements 111, 112. A single turn between the two coil elements 111, 112 is left in a state of having a margin so as to be projected slightly toward an upper side of the drawing and so as to be about twice in length in the lateral direction of the drawing as shown in FIG. 6 (manufacturing step 1). Corner areas of the interconnection part 113 with the margin are formed by bending the flat wire 101 at a right angle in the manner of edgewise-winding as shown in the drawing. The portions bent at a right angle are formed as the edgewise-winding portions 123A2, 123B2.

Note that winding directions of the two coil elements 111 and 112 are the same.

Next, as shown in FIG. 7, in the part to be the interconnection part 113, the flat wire 101 is bent at a right angle in the manner of flatwise-bending between the part referred to as the edgewise-winding portion 123A2 and the winding end portion 111D of the first coil element 111 to form the flatwise-bending portion 123A1. Similarly, as shown in FIG. 7, in the part to be the interconnection part 113, the flat wire 101 is bent at a right angle in the manner of flatwise-bending between the part referred to as the edgewise-winding portion 123B2 and the winding start portion 112D of the second coil element 112 to form the flatwise-bending portion 123B1 (manufacturing step 2).

Then, from the state shown in FIG. 7, the first coil element 111 is rotated about the axis of the coil element 111 counterclockwise in the drawing by 180 degrees to be set in the state shown in FIG. 8. At this time, the interconnection part 113 is formed to be bent by 180 degrees between an edge of the edgewise-winding portion 123A2 and an edge of the intermediate part 123C.

Note here that "flatwise-bending" is that the flat wire is bent in a direction of the long side by having one face on the long-side side of the rectangular section of the flat wire as an inner diameter face and the other face as an outer diameter face.

As described, through executing manufacturing steps 1 to 3 in order, the intermediate part 123C provided to be drawn from one of the first coil element 111 and the second coil element 112 to the other is provided to have the linear face in parallel to the plane that is in parallel to both the disposing direction of the two coil elements 111, 112 and the axial direction of the two coil elements 111, 112, and the intermediate part 123C of the interconnection part 113 is formed in an untwisted state.

Embodiment 2

In this second embodiment, there are many members common to the members of the first embodiment described above. Therefore, reference numerals acquired by adding 100 to the reference numerals of the members of the first embodiment are applied to such common members, and detailed explanations of such members are to be omitted.

Figure 9:
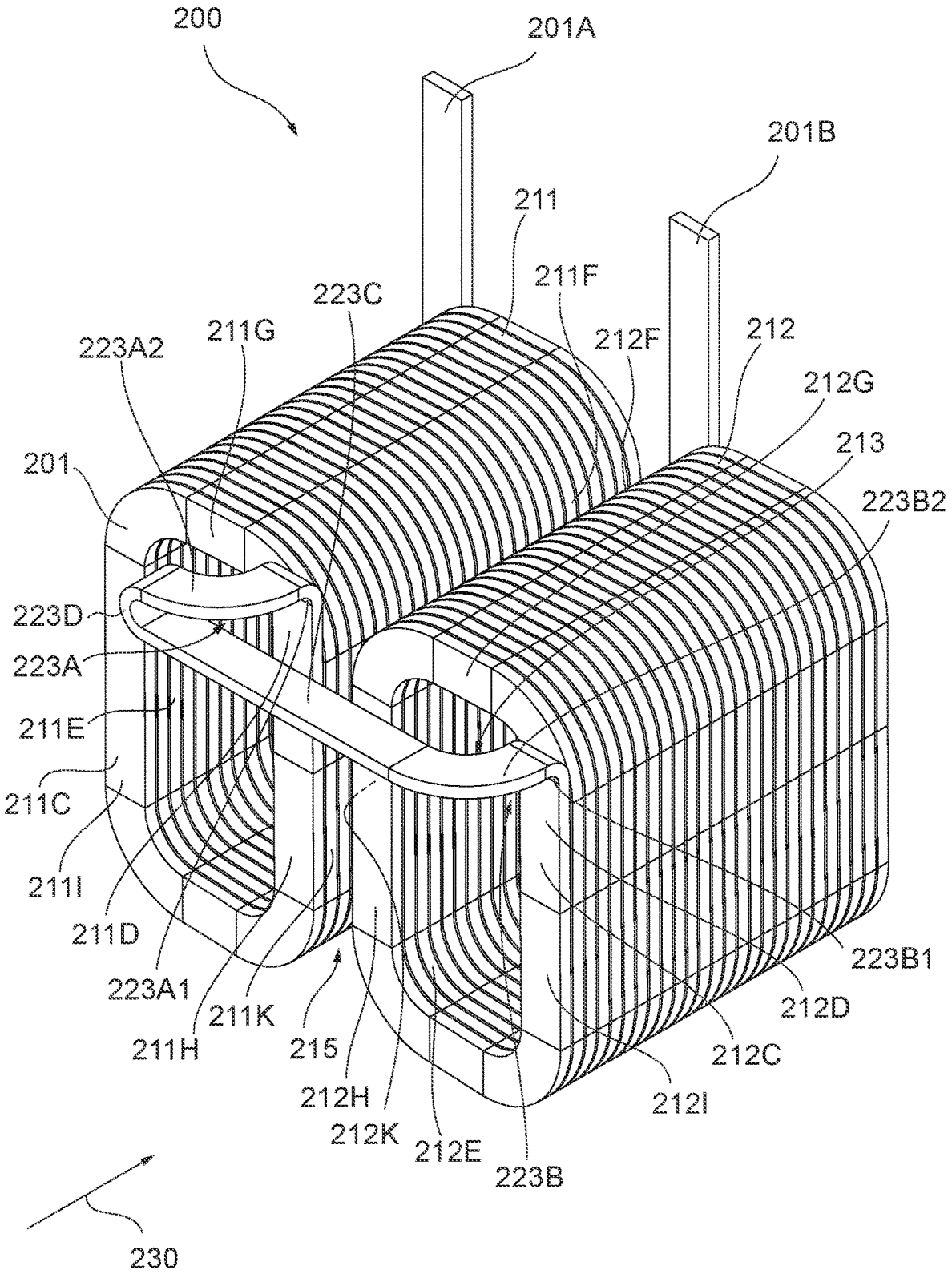
FIG. 9 is a perspective view of a coil component according to a second embodiment of the present invention.

That is, as shown in FIG. 9, a coil component 200 of the second embodiment is similar to the coil component 100 of the first embodiment described above in respect that the coil component 200 is configured by winding and laminating a single flat wire 201 with edgewise-winding between one end portion 201A and another end portion 201B as connection terminals, and bending the wound and laminated coil into two at a prescribed position (normally at substantially middle position) to provide a first coil element 211 and a second coil element 212 each formed in an angular-tubular shape and disposed in parallel and to provide an interconnection part 213 for connecting the both coil elements 211 and 212.

The first coil element 211 and the second coil element 212 are disposed in parallel such that respective side faces 211D, 212D opposing to each other are placed in parallel and along with each other with a prescribed space provided therebetween.

Further, the interconnection part 213 is configured with a first connecting part 223A, a second connecting part 223B, an intermediate part 223C, and an inverted part 223D.

Each element of the first connecting part 223A, the second connecting part 223B, the intermediate part 223C, and the inverted part 223D mentioned above is configured in substantially a similar manner as the first connecting part 123A, the second connecting part 123B, the intermediate part 123C, and the inverted part 123D of the first embodiment described above.

Note, however, that the intermediate part 223C of the present embodiment is located on a lower side with respect to the first connecting part 223A in FIG. 9, while the intermediate part 123C of the first embodiment described above is located on an upper side with respect to the first connecting part 123A in FIG. 1.

Even in such case where the intermediate part 223C is located on a lower side of the first connecting part 223A in FIG. 9 as described above, the intermediate part 223C provided to be drawn from one of the first coil element 211 and the second coil element 212 to the other is provided to have the linear face in parallel to the plane that is in parallel to both the disposing direction of the two coil elements 211, 212 and the axial direction of the two coil elements 211, 212, and the intermediate part 223C of the interconnection part 213 is formed in an untwisted state.

Figure 10:
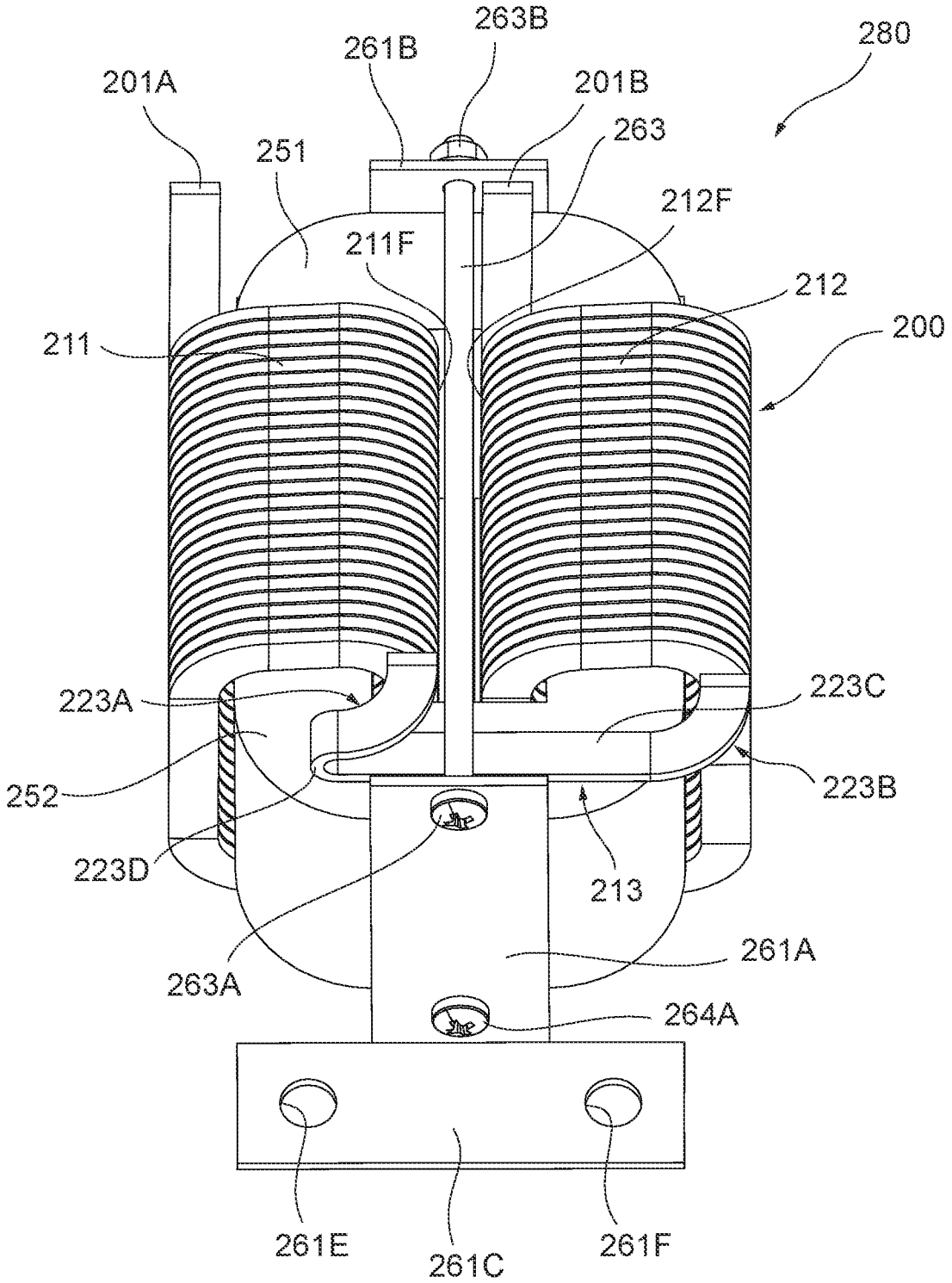
FIG. 10 is a perspective view showing a state where leg parts are attached to a coil device main body including the coil component according to the second embodiment shown in FIG. 9 loaded thereon.

FIG. 10 shows a coil device in which a pair of leg parts 261A, 261B are attached to a coil device main body (reactor main body) 280 acquired by combining the coil component 200 shown in FIG. 9 with the pair of cores 251, 252, and the coil component 200 is disposed at a position brought upward with respect to attaching portions 261C, 261D (not shown) of the leg parts 261A, 261B for a casing or the like.

In this case, as described above, the intermediate part provided to be drawn from one of the first coil element 211 and the second coil element 212 to the other is provided to have the linear face in parallel to the plane that is in parallel to both the disposing direction of the two coil elements 211, 212 and the axial direction of the two coil elements 211, 212. Therefore, as shown in FIG. 10, the intermediate part 223C is different from the intermediate part of the first embodiment in respect that the intermediate part 223C is disposed to come between the long screw 263 used for fastening and a top surface of the core 252. However, the long screw 263 can be provided to be in parallel to the linear face of the intermediate part 223C easily. Therefore, like the first embodiment, mutual interference can be avoided easily, and efficiency of such attachment via the long screw 263 described above can be secured.

A manufacturing method of the coil component according to the second embodiment can also be described by using views showing steps of a manufacturing method of the coil component shown in FIGS. 6 to 8 as in the first embodiment. In the first embodiment, however, from the state shown in FIG. 7, the first coil element 111 is rotated about the axis of the coil element 111 counterclockwise in the drawing by 180 degrees to be set in the state shown in FIG. 8. In the present embodiment, from the state shown in FIG. 7, the first coil element 211 is rotated about the axis of the coil element 211 clockwise in the drawing by 180 degrees to be set in the state shown in FIG. 9. Thereby, the intermediate part 223C can be located on a lower side with respect to the first connecting part 223A in FIG. 9.

Note that the coil component and the coil device of the present invention are not limited to those of the above-described embodiments but various kinds of other modes can be employed. For example, while the intermediate part 123C of the interconnection part 113 of the above-described embodiment is located on the upper side of each of the coil elements 111, 112 in FIG. 1 and FIG. 8, the intermediate part

123C may be located on the lower side of each of the coil elements 111, 112 in FIG. 1 and FIG. 8.

Further, it is to be noted that the manufacturing method of the coil component is not limited to the manufacturing methods of the coil component depicted in the above-described embodiments but various kinds of manufacturing methods can be employed.

Further, in the embodiments described above, connecting points of the interconnection part 113 are provided in the vicinity of the edges of the longitudinal sides. However, the flat wire may be extended from the edges of the longitudinal sides and the connecting points may be set on the extended wire. Note that it is not preferable to set the connecting points in the midway of the longitudinal sides since the interconnection part interferes with the core.

Since insulation coating is applied on the outer surface of the coil component, it is possible to hold the coil device main body with the coil outer surface being in contact with the leg parts in case of being corresponding to low voltage.

Furthermore, while shown in the embodiments described above are the reactors (coil components) applied to the reactors used for automobiles, the coil component and the coil device according to the present invention are not limited to be used for automobiles but may be applicable to various kinds of application. For example, the coil component and the coil device of the present invention can be applied to reactors and the like used for solar power panels.

What is claimed is:

1. A coil component comprising:

a first coil element and a second coil element formed by dividing and folding, at a prescribed interconnection position, into two a winding coil formed by laminating a single flat wire into a rectangular shape with edge-wise-winding, the first coil element and the second coil element being disposed with opposing side-faces placed along in parallel to each other; and an interconnection part to connect those two coil elements, wherein a side of the first coil element and a side of the second coil element adjacent to each other among each of sides of a rectangular part forming interconnection end-faces of each of the coil elements and sides in parallel to those sides are referred to as first sides, the interconnection part connects the first side of the first coil element with the first side of the second coil element; and the interconnection part includes a first connecting part configured by, in an interconnection edge portion connected to one of the coil elements, bending and raising the first side at a right angle and then bending at a right angle in a manner of edgewise-winding toward a direction leaving away from another one of the coil elements along the interconnection end face, a second connecting part configured by, in another interconnection edge portion connected to the other one of the coil elements, bending and raising the first side at a right angle and then bending at a right angle in a manner of edgewise-winding toward a direction approaching the one of the coil elements along the interconnection end-face, an intermediate part including a linear face in parallel to a plane that is in parallel to both a disposing direction of the two coil elements and an axial direction of the two coil elements, the intermediate part being extended from the second connecting part toward a direction of the first connecting part to be drawn over a gap between the first coil element and the second coil element, and an inverted part in a 180-degree-folded shape for connecting an edge of the intermediate part and an edge of the first connecting part.

2. The coil component according to claim 1, wherein the first sides located on neighboring inner sides of the first coil element and the second coil element are referred to as inner first sides and the first sides located on outer sides are referred to as outer first sides, either one of the first connecting part and the second connecting part is connected in vicinity of an edge of one of the inner first sides of one of the two coil elements or on an extension of the inner first side, and the other one of the first connecting part and the second connecting part is connected in vicinity of an edge of the one of the outer first sides of the other one of the two coil elements or on an extension of the outer first side.

3. The coil component according to claim 1, wherein a linear face of the flat wire configuring the first connecting part and a linear face of the flat wire configuring the intermediate part are in parallel to each other.

4. A coil device comprising:

the coil component according to claim 1; and a magnetic core forming a closed magnetic path by inserting each leg part into a hollow part of the coil component.

5. The coil device according to claim 4, comprising:

a pair of device leg parts for holding a coil device main body formed by combining the coil component and the magnetic core at a prescribed position; and a long screw provided between corner areas of the two coil elements for pinching the coil component between the pair of device leg parts.

* * * * *